US008152088B2

(12) United States Patent
Gordon et al.

(10) Patent No.: US 8,152,088 B2
(45) Date of Patent: Apr. 10, 2012

(54) SYSTEM AND METHOD FOR STORAGE AND TEMPORARY INSTALLATION OF SECONDARY FLOORING SURFACE

(75) Inventors: Stephen D. Gordon, Cohutta, GA (US); Ryan W. Paris, Ringgold, GA (US); Gary L. Brock, Dalton, GA (US); Andrew E. Belles, Chatsworth, GA (US)

(73) Assignee: Textile Management Associates, Inc., Dalton, GA (US)

( * ) Notice: Subject to any disclaimer, the term of this patent is extended or adjusted under 35 U.S.C. 154(b) by 390 days.

(21) Appl. No.: 12/562,773

(22) Filed: Sep. 18, 2009

(65) Prior Publication Data

US 2010/0072315 A1 Mar. 25, 2010

Related U.S. Application Data

(60) Provisional application No. 61/098,543, filed on Sep. 19, 2008, provisional application No. 61/177,073, filed on May 11, 2009.

(51) Int. Cl.
*B65H 75/48* (2006.01)

(52) U.S. Cl. ..... 242/390.9; 242/393; 242/399.1; 242/541.1; 242/563.2; 242/564.5; 242/592; 242/919

(58) Field of Classification Search ..... 242/389, 242/390, 390.2, 390.8, 390.9, 393, 399, 399.1, 242/535, 535.3, 540, 541, 541.1, 542, 544, 242/563, 563.2, 564, 564.5, 591, 592, 595, 242/595.1, 919

See application file for complete search history.

(56) References Cited

U.S. PATENT DOCUMENTS

| | | | |
|---|---|---|---|
| 3,099,444 | A | 7/1963 | Burt |
| 4,084,763 | A | 4/1978 | Zamboni |
| 4,399,954 | A | 8/1983 | Arrant |
| 4,588,189 | A | 5/1986 | Arrant |
| 4,640,469 | A | 2/1987 | Mackintosh |
| 4,738,407 | A | 4/1988 | Arrant |
| 5,456,566 | A | 10/1995 | Kniley et al. |
| 5,962,101 | A | 10/1999 | Irwin, Sr. et al. |
| 6,070,824 | A | 6/2000 | Du Pont |
| 2010/0200688 | A1 | 8/2010 | Gordon et al. |

FOREIGN PATENT DOCUMENTS

| | | |
|---|---|---|
| DE | 2417729 | 10/1975 |
| JP | 07206232 | 8/1995 |
| WO | WO-2010033840 A1 | 3/2010 |

(Continued)

OTHER PUBLICATIONS

The AstroTurf Engineered, One-Piece Turf Conversion System, Magic Carpet, Astroturf Sports Surfaces Brochure, AstroTurf Sports Surfaces, Leander, Texas, Jun. 1998.

(Continued)

*Primary Examiner* — William E Dondero
(74) *Attorney, Agent, or Firm* — Kilpatrick Townsend & Stockton LLP

(57) ABSTRACT

Systems and methods of rolling and unrolling secondary flooring surfaces, such as tall pile polyethylene turf, are provided. The system includes a drive system that allows for the conversion of a primary surface into a secondary flooring surface in a relatively short period of time. The drive system includes core adjustable speed drive units for controlling the speed and torque of the motors that drive the core, as well as roller adjustable speed drive units for controlling the speed of the front roller. The core adjustable speed drive units control the torque of the core motors during roll up and control the speed of the core motors during roll out.

29 Claims, 9 Drawing Sheets

FOREIGN PATENT DOCUMENTS

WO WO-2010091252 A1 12/2010

OTHER PUBLICATIONS

Your Pitch Covered in Minutes, Matchsaver Automated Pitch Protection Brochure, Matchsaver, Middlesbrough, Teesside, UK, 2002.

Maximize Your Venue Potential, Minimize Your Conversion Time, Conversion Systems, AstroTurf Brochure, GeneralSports Venue, Raleigh, North Carolina, 2007.

PCT/US2009/057534 International Search Report and Written Opinion mailed Feb. 1, 2010.

International Application No. PCT/US2009/057534, International Preliminary Report on Patentability mailed on Mar. 31, 2011, 8 Pages.

International Application No. PCT/US2010/023319, International Preliminary Report on Patentability mailed on Aug. 18, 2011, 5 Pages.

International Application Serial No. PCT/US2010/023319, International Search Report mailed Jul. 20, 2010.

International Application Serial No. PCT/US2010/023319, Written Opinion mailed Jul. 20, 2010.

SYSTEM AND METHOD FOR STORAGE AND TEMPORARY INSTALLATION OF SECONDARY FLOORING SURFACE

CROSS-REFERENCE TO RELATED APPLICATIONS

This application claims priority to U.S. Provisional Application Ser. No. 61/098,543, titled "System and Method for Storage and Temporary Installation of Artificial Turf," filed Sep. 19, 2008, and U.S. Provisional Application Ser. No. 61/177,073, titled "System and Method for Storage and Temporary Installation of Secondary Flooring Surface" filed on May 11, 2009, the entire contents of both of which are incorporated herein by reference.

BACKGROUND OF THE INVENTION

Artificial turf, also known as synthetic turf, is a surface manufactured from synthetic materials designed to look and perform like natural grass. Artificial turf is commonly used in the athletic industry and is also used in both commercial and residential landscaping applications. Artificial turf may be formed from nylon fibers and/or polyethylene fibers, among others. Some artificial turf surfaces use an infill material between the artificial fibers and are referred to as "infill surfaces." The infill material is comprised of "resilient" granules, which may be made of, for example, rubber, cryogenically ground rubber, EPDM rubber, cork, polymer beads, polymer foam, styrene, perlite, neoprene, sand, gravel, or granulated plastic, among other materials.

Artificial turf is desirable when the use of natural turf is inconvenient, expensive, or unfeasible. Some climates force athletic teams indoors for training and practice and, depending on the sport, a soft or grass-like surface may be necessary. Professional sports teams may be located in climates that necessitate the use of artificial turf in an indoor stadium. In addition, some consumers may find it prohibitively expensive to maintain a properly landscaped surface with natural turf, and artificial turf can provide a low-maintenance alternative.

Systems providing a portable, removable, and storable artificial turf or other secondary flooring surface are beneficial because they allow use of both a primary and secondary flooring surface in a single venue. For example, a secondary flooring surface may be temporarily placed on a gymnasium floor or other primary surface for selected sports and activities and later removed.

At least one existing installation system designed to unroll temporary artificial turf is capable of accommodating only products formed from short pile knitted nylon with a knitted backing that is coarser, yet more durable, than other turfs. This type of existing system was specifically designed for use with short pile knitted nylon type turf and is not capable of deploying turf systems formed from other materials or systems with tall pile heights. Even when used with knitted nylon turf, this type of existing system has drawbacks, such as roll telescoping as it is rolled up or sagging as the roll is rolled out. Moreover, this type of existing system can only be operated at one speed that cannot be controlled. This lack of system control leads to directionality issues and can lead to the turf creasing, tearing, and distorting.

Artificial turf formed from polyethylene fibers has been used because it is relatively softer and taller than traditional nylon products, and can be tufted. Polyethylene artificial turf has a pile height that is about two inches higher than the short and compact traditional nylon artificial turf, which is typically no higher than ½ an inch in height.

Attempts to roll and unroll an artificial turf having tall pile polyethylene fibers using an existing installation system result in broken backings, slipping, and bagging that congregates at either end of a roll. For example, the taller polyethylene fibers cause the roll to slip as it is unrolled and rolled. Slippage is undesirable because it can result in damage to the artificial turf. In contrast, nylon artificial turf has more "grip," because the nylon fibers are not as slippery, allowing a more even roll-up process. Thus, existing systems cannot deploy newer types of artificial turf, such as ones comprised of tall pile, including those comprised of polyethylene fibers and infill systems.

Although some conventional systems are capable of rolling and unrolling taller pile heights, including polyethylene fibers, these systems can only accommodate narrow sections of artificial turf or other secondary flooring on a roll and are pile height dependent. With these existing systems, the machine moves to roll up and unroll the artificial turf, and the artificial turf remains stationary. Because the turf remains stationary, these conventional systems require lift trucks to transport the rolls. This limits the width of the roll that can be used because these lift trucks cannot handle the weight of a single roll of artificial turf or other secondary flooring or handle a roll if it is too wide.

Thus, these conventional systems can only accommodate narrow rolls, and therefore require many pieces of artificial turf or other secondary flooring to cover an existing primary surface. These pieces are rolled into separate rolls, so a large storage area is required to store all of the numerous rolls of artificial turf or other secondary flooring. When these separate rolls are unrolled, the individual pieces must be seamed together to form the secondary flooring surface. Furthermore, when the rolls are unrolled to lay out the secondary flooring system, these pieces must be installed in the proper order, which is cumbersome and time consuming. Unrolling artificial turf or other secondary flooring with conventional systems is time consuming and can require as much time as 20-30 minutes per roll. Thus, rolling up a secondary flooring surface, such as an athletic field, and storing the rolls could take up to 9-10 hours or more using a conventional system.

Conventional carpet roll up systems are not suitable for use with artificial turf because the tensioning of carpet roll up systems is not appropriate for artificial turf and other types of flooring other than carpet. The conventional method of tensioning carpet cannot be accomplished on artificial turf because the machine cannot accommodate the wide width of turf. If the system is made wide enough to accommodate turf, additional support would be necessary, which would then interfere with the threading process.

Thus, there is a need for a system capable of effectively rolling and unrolling secondary flooring surfaces, such as tall pile artificial turf, including tall pile polyethylene turf, and/or infill systems. There is also a need for a system capable of rolling and unrolling secondary flooring surfaces having a greater roll width and weight. There is also a need for a system that accommodates a variety of secondary flooring surfaces, including but not limited to, tufted or knitted products, tall or short pile products, rubberized flooring systems, floor coverings, natural sod, infilled and non-infilled products, or any other surface used to cover and/or protect a primary surface. These secondary flooring surfaces are not limited to those used in the athletic industry.

SUMMARY OF THE INVENTION

Provided are systems and methods of rolling and unrolling secondary flooring surfaces, such as tall pile polyethylene turf, and any other floor covering that covers and/or protects a primary surface. The system includes a drive system that allows for the conversion of a primary surface into a secondary flooring surface in a relatively short period of time. In some embodiments, the system includes a core that is driven by at least one core motor that is controlled by a core drive unit, as well as first and second rollers for supporting the secondary flooring system and guiding the secondary flooring surface on and off the core. In some embodiments, the second roller is driven by at least one roller motor that is controlled by a roller drive unit. In some embodiments, the drive system includes core adjustable speed drive units for controlling the speed and torque of the motors that drive the core, as well as roller adjustable speed drive units for controlling the speed of the front roller. The core adjustable speed drive units control the torque of the core motors during roll up and control the speed of the core motors during roll out.

DETAILED DESCRIPTION

Systems and methods of this invention store and install and un-install a temporary secondary flooring surface 40, such as artificial turf, carpet, rubberized flooring, natural sod, or other suitable secondary flooring, on an existing primary surface 38. For example, systems of this invention unroll a secondary flooring surface to cover temporarily a primary surface, such as a gymnasium floor or a domed stadium. After use, the secondary flooring surface can be rolled up for storage. Systems and methods of this invention allow the conversion of a large primary surface to a secondary flooring surface in a short period of time with a limited amount of labor. The primary surface may be generally flat, or may be domed to allow for drainage. The secondary flooring surface may optionally include a pad underneath to provide additional strength, cushioning, and stability to the secondary flooring surface.

Systems of this invention also allow the user to choose from a number of different types of secondary flooring surfaces such as, but not limited to, a tufted or knitted product, a tall or short pile product, rubberized flooring systems, natural sod, carpet, an infilled or non-infilled surface, or any other suitable surface for covering and/or protecting a primary surface. All of these secondary flooring surfaces may be unrolled onto a primary surface and then rolled up and removed. In one embodiment, for example, systems of this invention roll up and unroll a tall pile, infilled synthetic artificial turf in a short period of time. The time required for converting a primary surface to the secondary flooring surface depends, in part, on the square footage of the primary surface, and in particular the length of the primary surface.

Some benefits of systems of this invention include lack of distortion, stretching, and bunching of the secondary flooring surface, reduced infill migration and loss, and reduced damage and distortion of the secondary flooring surface. In other words, the secondary flooring surface is rolled up and is unrolled evenly and neatly. An uneven roll up process would likely result in product damage to the secondary flooring surface. Moreover, an uneven roll up process would likely result in congregating and bunching of the secondary flooring surface in certain spots, which could affect surface performance or athletic performance and eventually result in a non-functioning system.

Some embodiments of this invention roll up and unroll a secondary flooring surface on a single roller that is generally the same width as the primary surface. In this way, the secondary flooring surface can be installed on the primary surface from a single roll, which is faster and easier than creating a secondary flooring surface from several fragmented rolls. These embodiments of this invention also allow the rolled up secondary flooring surface to be rolled up into a single roll and then stored as a single roll.

Figure 1:
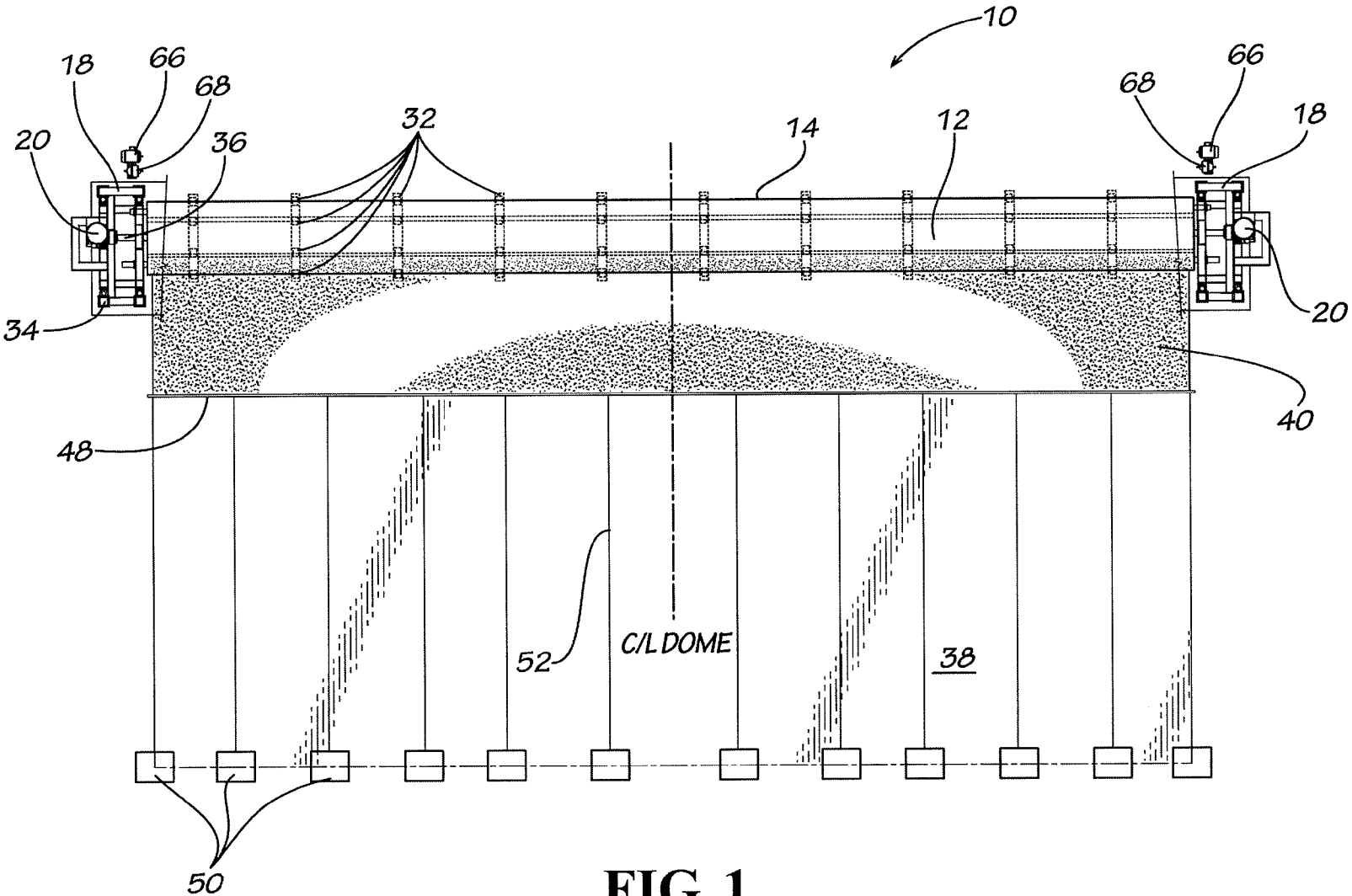
FIG. 1 is a top view of an embodiment of a system for storage and temporary installation of a secondary flooring system as the primary surface is being converted.
Figure 2:
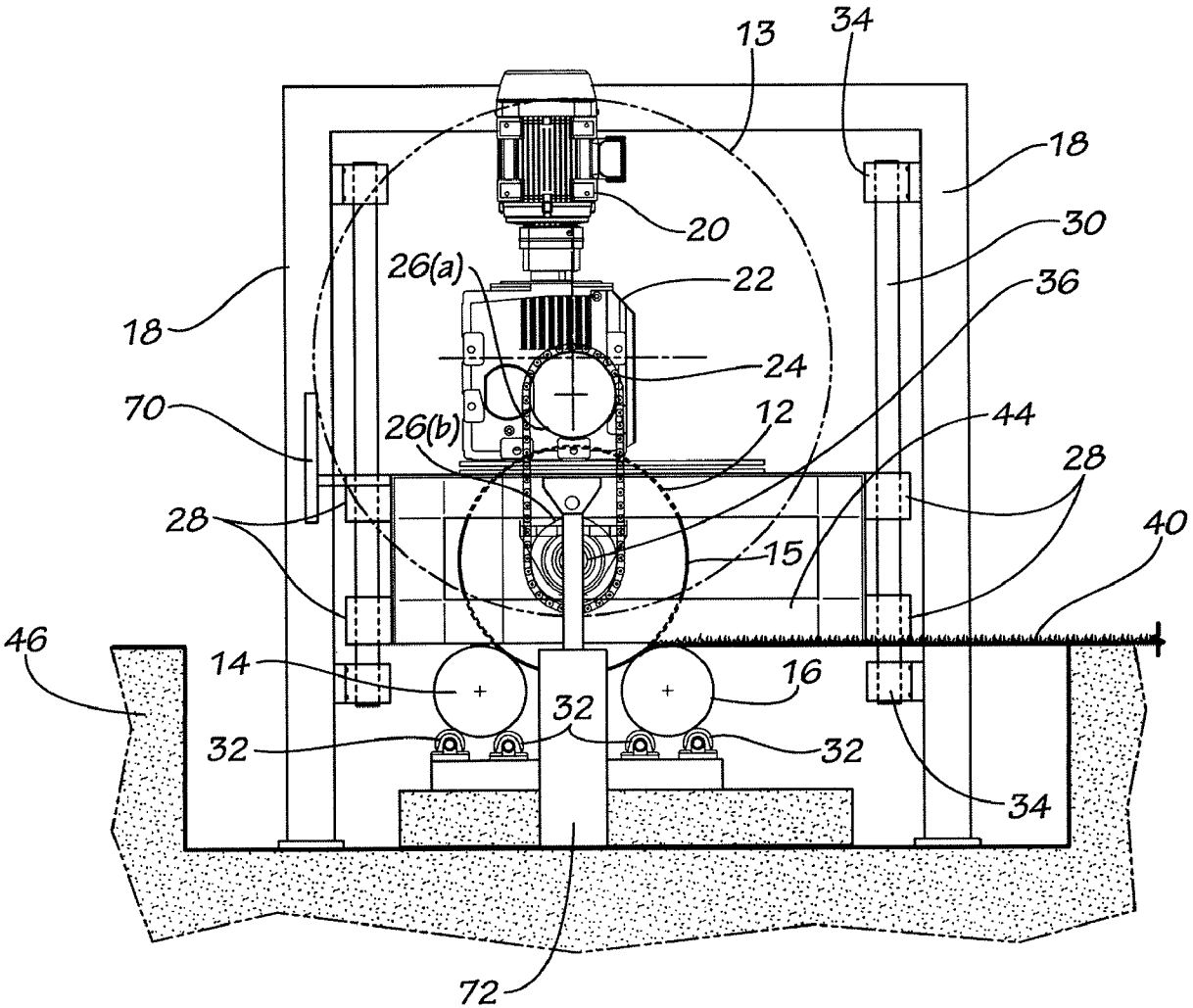
FIG. 2 is an end view of the system of FIG. 1.

In certain embodiments according to the invention, as shown in FIGS. 1-4, the conversion system 10 includes a core 12 formed from steel or other suitable material. Conversion system 10 may be stored in a full or partial pit 46 (shown in FIG. 2) or mounted directly on the primary surface 38. Alternatively, the system may be a Mezzanine mounted system. If the system is a full pit mounted system, the system may include a retractable hydraulic lid that covers the storage pit when not in use. In some embodiments, the system may be mounted in a moveable manner—as one example, the system could optionally be used with a hydraulic lift capable of lifting the system out of a pit to align it with the height of the primary surface. In yet another embodiment, the system might be mounted behind a wall having a retractable door. The secondary flooring 40 is rolled around the core 10 during the roll up process. As shown in FIG. 2, the conversion system 10 includes a first roller 14 and a second roller 16. The first and second rollers 14 and 16 can be formed from steel or other suitable material. FIG. 2, which is an end view of the conversion system 10, shows that the rollers 14 and 16 rest on cradle rollers 32. The cradle rollers 32 allow the rollers 14 and 16 to rotate. Cradle rollers 32 are shown in FIG. 1 in dotted lines for perspective, although cradle rollers 32 would not otherwise be visible in this view. FIG. 2 illustrates two different amounts of secondary flooring on the core. Line 13 illustrates the secondary flooring when approximately all of the secondary flooring is rolled on the core and line 15 illustrates the secondary flooring when approximately all of the secondary flooring is rolled off the core.

The center shaft 36 of the core is located between and above the axis of the first roller 14 and the axis of the second roller 16. The position of the center shaft 36 relative to the first and second rollers changes as the secondary flooring rolls up or off the core. As the secondary flooring 40 rolls off the core, it passes over the first roller 14, over the second roller 16, and then onto the primary surface, as shown in FIG. 2. As the secondary flooring 40 is rolled onto the core, it passes from the primary surface over the second roller, over the first roller and then onto the core. In one embodiment that supports secondary flooring with a length of approximately 426 feet and a width of approximately 220 feet (this embodiment will be referred to herein as the First Embodiment), the center shaft is approximately 6" in diameter, the core is approximately 48" in diameter, and the first and second rollers are approximately 16" in diameter. In another embodiment that supports secondary flooring with a length of approximately 200 feet and a width of approximately 15 feet, the center core is approximately 30" in diameter and the first and second roller are approximately 12" in diameter (this embodiment will be referred to herein as the Second Embodiment).

Figure 3:
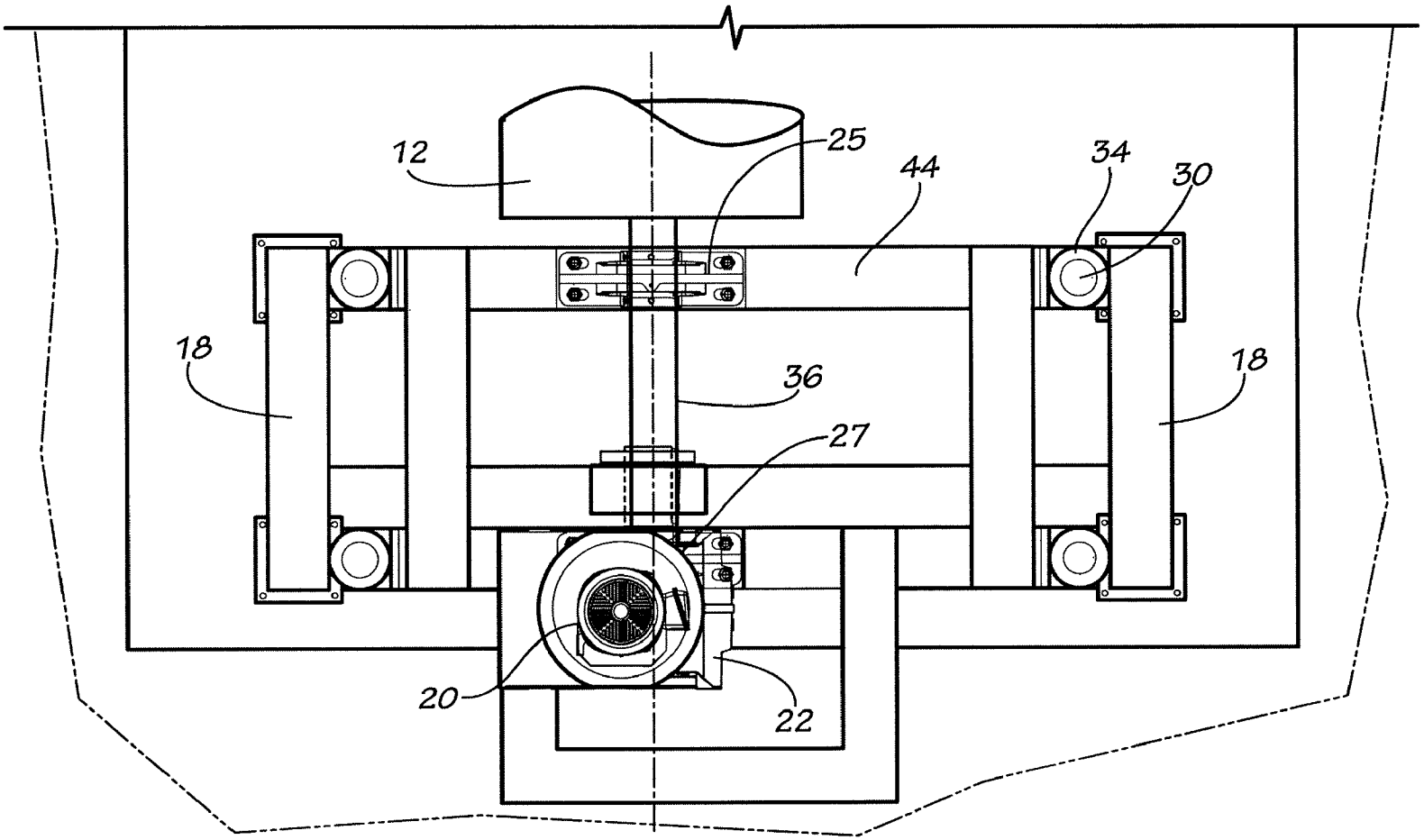
FIG. 3 is a partial top view of the system of FIG. 2.
Figure 4:
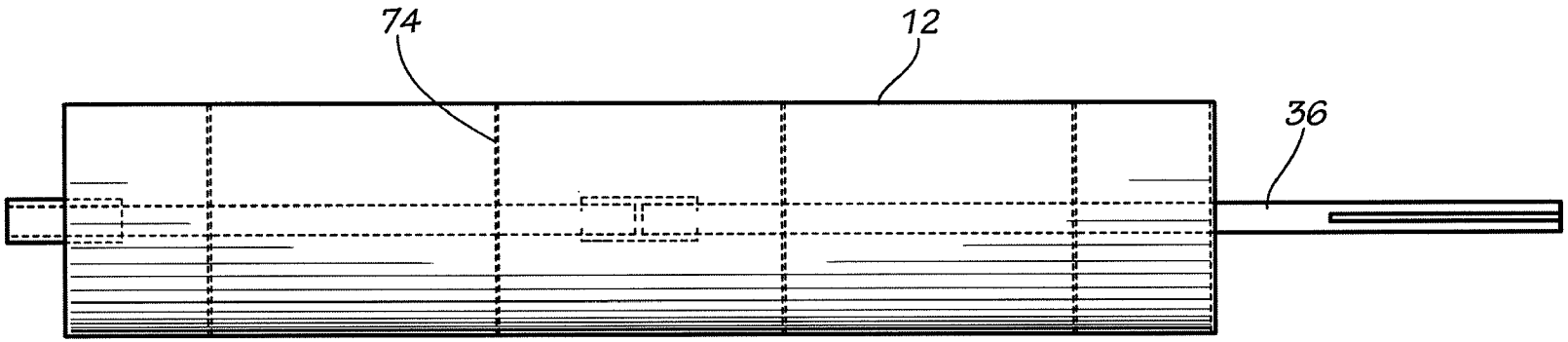
FIG. 4 is a partial top view of a core according to one aspect of the invention.
Figure 5:
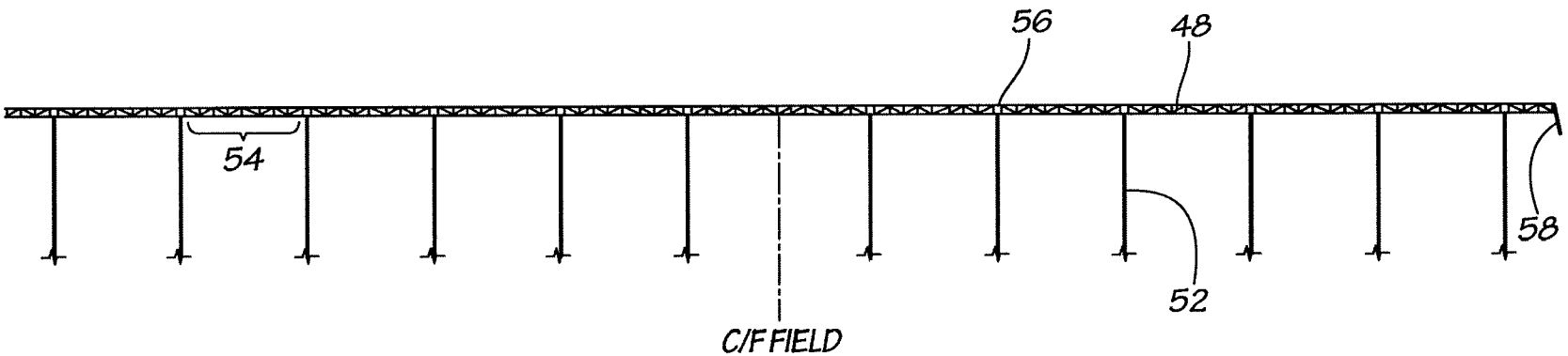
FIG. 5 is a top view of a spar and winch system according to one aspect of the invention.
Figure 6:
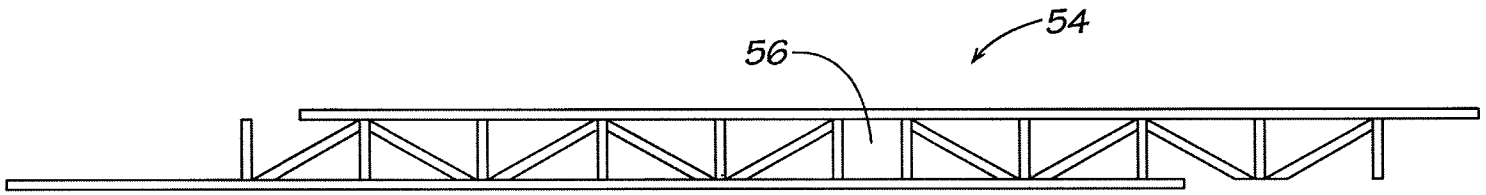
FIG. 6 is a partial top view of the spar of FIG. 5.
Figure 7B:
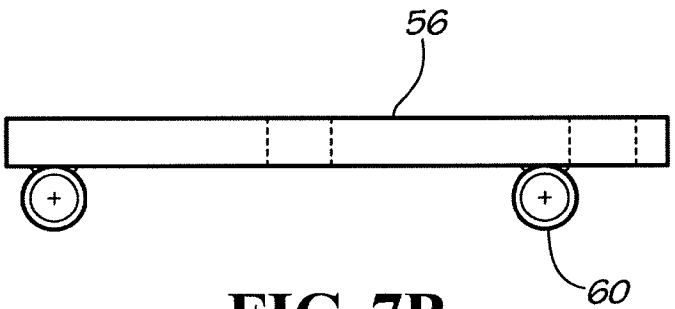
FIG. 7B is a side view of the wheel segment of FIG. 7A.
Figure 7A:
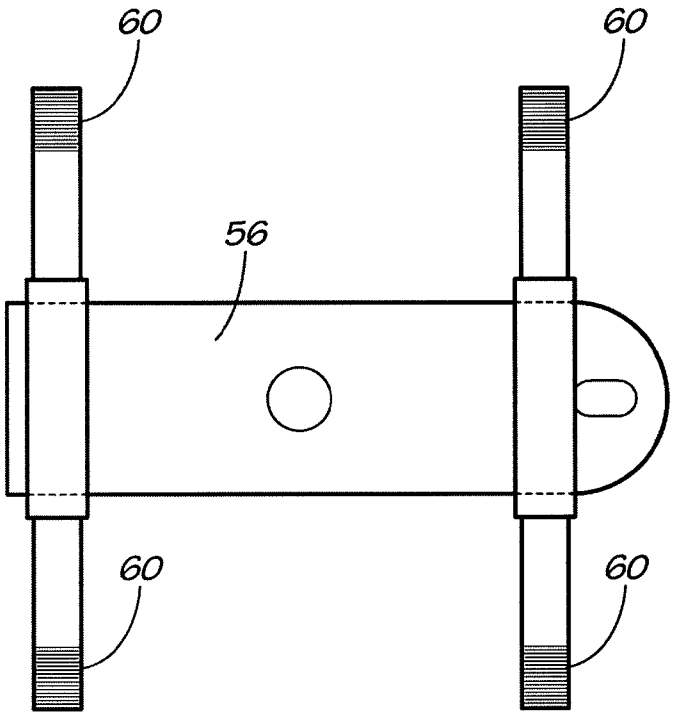
FIG. 7A is top view of the wheel segment of FIG. 5.

A core motor 20 and a gear box 22 are located at each end of core 12 and drive rotation of center shaft 36 via chain 24 and sprockets 26*a*, 26*b*. FIG. 4 illustrates a portion of the core 12 and the center shaft 36. The core includes steel support headers 74. In the First Embodiment, the support headers are provided on 5 foot centers along the length of the core. The center shaft 36 extends from the core 12 and through pillow block bearings 25 and 27, as shown in FIG. 3. FIG. 2 illustrates that the end of the center shaft 36 is engaged by the gearbox 22 via a chain 24 and sprockets 26*a*, 26*b*. The rotation of center shaft 36 causes core 12 to rotate. Core motors 20 provide the power necessary to turn the core 12 and roll the secondary flooring 40 onto the core. In this way, the core 12 becomes a center winder driven by the core motors. This center winder acts with the rollers 14 and 16 to roll up the secondary flooring surface around the core 12.

A roller motor 66 is located at each end of the second roller 16 (also referred to herein as the front roller) and together the motors drive rotation of the front roller. Roller motor 66 drives gear box 68 via belts, and gear box 68 drives front roller 16 via a chain. The first roller 14 is free spinning during both roll up and roll out.

In one embodiment, each of the core motors and the roller motors are controlled by a separate adjustable speed drive unit. Exemplary motors and drive units for the First Embodiment include 25 hp, 480 volt, 3 phase, 1750 RPM motors and G9 Adjustable Speed Drives (25 hp model), both available from Toshiba. Although this embodiment uses the same size motors to drive both the core and the front roller, other embodiments may use different motors to drive the core and the front roller. The core drive unit supports at least a torque mode and a speed mode and can control the core motors in both modes. For some embodiments, the core drive unit is an adjustable speed drive unit to vary the speed of the core during roll out. The core motors have sufficient power to drive the core when the secondary flooring is rolled onto the core. The roller drive unit provides a speed mode and can control the speed of the roller motor. Although the Figures illustrate that the core and the second roller are driven by a pair of motors, not all embodiments use a pair of motors. Depending on the width and/or length of the secondary flooring surface, the second roller and/or the core may be driven by a single motor, or more than two motors.

Sand or other material may be added to the core in some embodiments. If so, the material is added to the middle section of the core and tapers down towards the ends. For example, there is sand in a section of the core in the First Embodiment. The section is approximately 100 ft long and is centered at the midpoint of the core. The sand is distributed so that it is heaviest at the midpoint of the core and tapers down as it approaches the ends of the 100 ft section. Without the sand, the heaviest part of the core in the First Embodiment is towards the ends of the core and the secondary flooring is thus susceptible to wrinkling toward the ends of the core as the secondary flooring is rolled onto the core. The sand helps equalize the weight of the core and also facilitates a more even roll up process of the secondary flooring material onto the core.

Figure 8B:
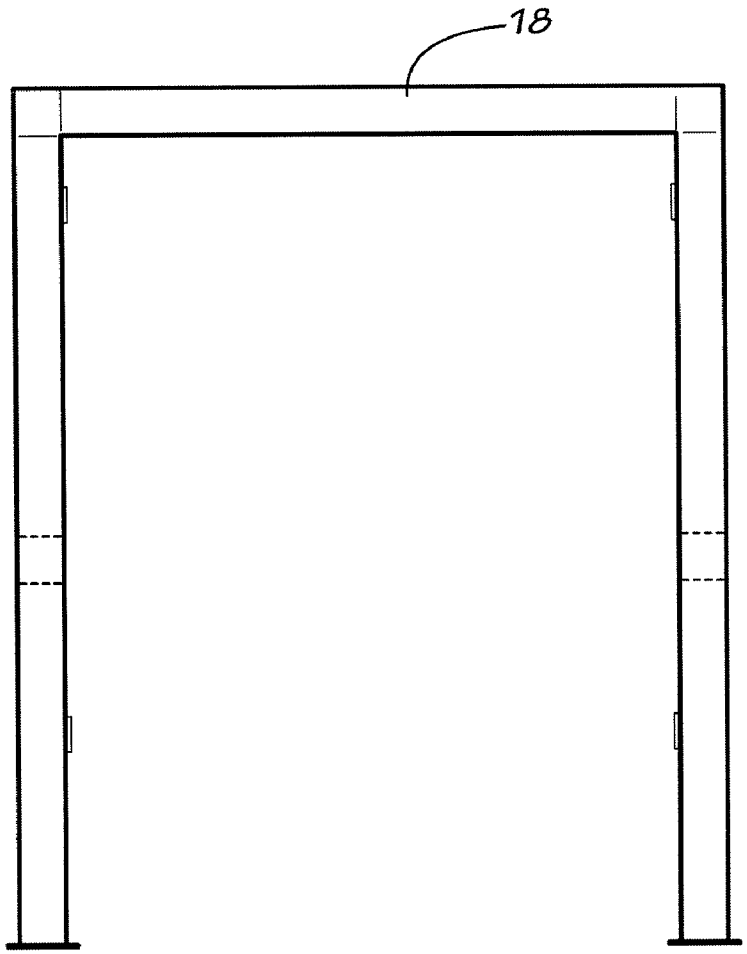
FIG. 8B is a front view of the end frame of FIG. 8A.
Figure 8A:
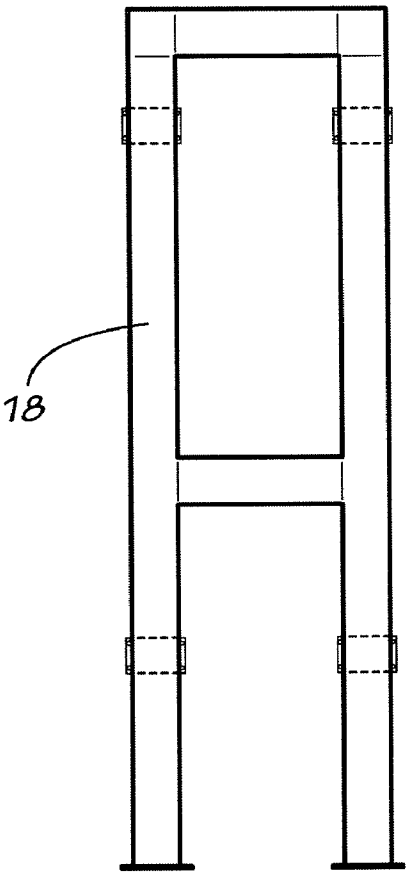
FIG. 8A is a side view of the end frame of FIG. 2.

The core is mounted on end shafts 30 having linear bearings 28 that allow the frame 44 on which the core rests (and thus the core 12) to float up or down as the roll of secondary flooring 40 increases or decreases in diameter around the core, as further described below. End shafts 30 also include clamp blocks 34 that attach the end shafts 30 to end frame 18, as shown in FIGS. 2-3. End frame 18 is shown in isolation in FIGS. 8A-8B. Allowing the core 12 to float up and down helps to maintain an approximately constant tension during the roll up process. The end shafts 30 stabilize the core 12 as the diameter of the core 12 gets bigger due to the secondary flooring 40 wrapping around the core 12 in the roll up process. The end shafts 30 may be made of steel or any other suitable material to stabilize the core 12.

In some embodiments, as shown in FIG. 2, an optional hydraulic lift 72 may be used at either end of the core to assist with lifting and lowering the core 12. Specifically, as a cylinder in the hydraulic lift 72 extends, pressure forces a piston upward to help support the weight of the core 12. As the cylinder extends, constant pressure is maintained to raise the core 12 at a steady rate. A relief valve may be used to maintain constant pressure as the core is lowered.

In some embodiments a linear voltage displacement transducer ("LVD") 70 is used to determine the position of the frame 44 along one of the end shafts 30 and provide the information to the core adjustable speed drive units. In other embodiments, the position may be determined relative to the end frame 18. In any of these embodiments, the position of the frame provides information about the roll diameter and is used during the roll out process. The inventors found that an LVD was useful in the First Embodiment where the diameter of the core with the secondary flooring rolled on the core was approximately 8 feet. The LVD was not necessary in the Second Embodiment where the diameter of the core with the secondary flooring rolled on the core was approximately 5 feet.

In other embodiments, rollers 14 and 16 are mounted on the end shafts 30 or on a frame to allow the rollers to float up or down, instead of allowing the core to float up and down. In one of these embodiments, the rollers 14 and 16 can be set on linear ball bearings and as the weight and/or diameter of the roll of secondary flooring increases, the rollers go down and as the weight/diameter of the roll decreases, the rollers go up. The vertical movement of the core 12 or alternatively of the rollers helps control any roll telescoping, bagging, or tearing.

Also disclosed are methods of rolling up and unrolling a secondary flooring 40 using the system described above. To begin the roll up process, the motors 20 and 66 controlling the core 12 and second roller 16 respectively are started and are configured to drive the core and the second roller in a direction that causes the secondary flooring to roll onto the core. As discussed above, the core becomes a center winder that helps roll up the secondary flooring surface. The roller adjustable speed drive units are programmed to maintain a fixed speed in the roll up process. The speed is typically determined by the desired roll up/roll out time and the length of the secondary flooring. The roll up time is the time it takes to roll the secondary flooring onto the core and the roll out time is the time it takes to roll the secondary flooring off the core. For example, the speed in the First Embodiment corresponds to rolling the secondary flooring at approximately 20 ft/min., which is based on a roll out/roll up time of approximately 20-25 minutes and a length of approximately 426 feet. The surface speed in the Second Embodiment also corresponds to rolling up the secondary flooring at approximately 20 ft./min.

The core adjustable speed drive units are programmed to set the torque for the core motors to provide a relatively tight roll given the speed of the front roller motors and the amount and type of the secondary flooring. Because the system accommodates secondary flooring surfaces of different types, for example, turf made from different yarn, construction, pile height, and in-fill, among others, it is desirable for the system to be able to adjust the motor parameters to fit the particular type of secondary flooring surface used and the specific needs of each venue. The amount and type of the secondary flooring determine the weight and diameter of the secondary flooring when it is rolled on the core. The tightness of the roll is acceptable when the secondary flooring can roll out without wrinkling or telescoping and there is no excessive crushing of the pile. If the secondary flooring is rolled too tightly, then the pile may be crushed and may require more grooming time, which increases the conversion time. As the roll of secondary flooring 40 increases in size, the center frame 44 upon which the core 12 is mounted floats up on linear ball bearings 28 and end shafts 30 as described above or alternatively the rollers float down. Once the secondary flooring is rolled onto the core, the core motors and the front roller motors are turned off. In some embodiments, the starting and stopping of the system is manual, so that an operator starts and stops the motors using a control box. In other embodiments, the system starts and stops automatically. For example, the system in some embodiments includes a sensor that senses the amount of secondary flooring on the core or the position of the spar, which is described below, to determine when to turn off the motors.

In the First Embodiment, the secondary flooring is a tufted turf comprising polyethylene fibers with an approximately 2.5 in. pile height, a face weight of approximately 60-oz./sq. yd., and having approximately 3 lbs./sq. foot of infill. The finished product weight of the secondary flooring is approximately 2 lbs./sq. ft. For the First Embodiment, the torque setting for the core motors is 60% of the total torque that the motors are capable of delivering and is maintained throughout the roll up process.

In the Second Embodiment, the secondary flooring is a knitted polyethylene, nylon product comprising polyethylene fibers with a nylon root zone, the turf having an approximately 1 and ⅛ in. pile height. The fibers are adhered to an ⅝ in. PVC underpad and the turf has a face weight of approximately 56-oz./sq. yd. In this embodiment, the turf has no infill. The finished product weight of the secondary flooring of the Second Embodiment is 3.5-4 lbs./sq. ft. In the Second Embodiment, the torque setting for the core motors is 40%, and is maintained throughout the roll up process.

The systems of this invention do not require that the secondary flooring surfaces have a specific tilt or pile angle, as was required with conventional systems. Unlike conventional systems, where the secondary flooring surface had to be reversed to maintain a certain pile angle so that the secondary flooring surface would roll up properly, systems of this invention function properly regardless of the tilt or angle of the secondary flooring surface, because the system is programmed to adjust for the tilt or angle and compensate for any variations by adjusting the torque and/or speed of the core motors.

Also provided is a method for rolling out the secondary flooring 40 from the core 12. The motors 20 and 66 (controlling the core 12 and second roller 16 respectively) are started to begin the roll out process and are configured to rotate the core and the front roller in a direction that causes the secondary flooring to roll off the core. In the roll out process, the roller adjustable speed drive units are programmed to maintain a fixed speed. The speed can be the same as that used throughout the roll up process or can be different. In the First and Second Embodiments, the speed of the front rollers is the same for both roll up and roll out. During the roll out process the core acts as a brake to control the speed of the secondary flooring rolling off the core. Controlling the speed of the core prevents the secondary flooring from bagging as it comes off the core. In some embodiments, a single speed for the core motor is maintained throughout the roll out process. For example, in the Second Embodiment where the diameter of the core with the secondary flooring rolled on is approximately 5 feet, the speed of the core motor is approximately 32 Hz, which is maintained throughout the roll out process. However, in other embodiments where the dimensions of the secondary flooring are larger and thus the diameter is larger, the speed is adjusted during the roll out process. In these embodiments, the core adjustable speed drive units receive the position information from the LVD and adjust the speed of the core motor based on the amount of secondary flooring that remains on the core. As discussed above, the LVD indicates the position of the core relative to the end shaft or end frame, and thus indicates the diameter of the secondary flooring on the core. The core adjustable speed drive unit controls the speed of the core motor in a linear manner. In the First Embodiment, the core adjustable speed drive units start driving the core motors to operate at 14 Hz (when the diameter of the core and secondary flooring is approximately 5 feet) and adjust to 22 Hz by the end of the roll out process (when the secondary flooring has rolled off the core and the diameter of the core is approximately 48") in order to roll out the secondary flooring without any bagging.

In the First Embodiment, the core motors and the front motors are activated and deactivated at approximately the same time for both roll up and roll out. The acceleration and deceleration profiles of the motors are also approximately the same and follow a linear pattern. Other embodiments may use different acceleration and/or deceleration profiles, such as non-linear patterns, so long as the profiles are common between the motors.

An optional winch and cable system, shown in FIGS. 5-7B and 9-11, can pull the secondary flooring 40 across the primary surface 38 on which the secondary flooring 40 is to be installed. The winch and cable system includes a spar 48 connected by cables 52 to a plurality of winches 50. The winch and cable system pulls the secondary flooring 40 from one end of the primary surface 38 to the other end of the primary surface 38 on which the secondary flooring 40 is to be installed. The spar 48 provides a leading edge to the secondary flooring 40. Spar 48 can be formed from rigid steel or other suitable material and is prefabricated into spar sections 54. In some embodiments, the spar sections can be approximately 20 foot long sections or any suitable length. In between each spar section 54 is a wheel section 56, shown in FIGS. 6 and 7A-7B. Wheel section 56 includes wheels 60 that help move and steer spar 54. Wheels 60 also lift the spar 54 off of the primary surface 38 to avoid dragging the spar 54 along the primary surface 38.

Spar 48, the length of which corresponds to the width of the secondary flooring 40, helps maintain alignment of the secondary flooring 40 and includes a steering mechanism 58 (shown in FIG. 5) that can be used to manually or automatically steer the secondary flooring 40 as it is rolled out. Steering mechanism 58 can include a series of gear reducers to make steering the spar 48 easier. Spar 54 also helps keep the system from stretching or distorting the secondary flooring 40. In some embodiments, the steering mechanism 58 can be manually operated by a single individual to control the spar 54. In other embodiments, steering mechanism 58 is configured to automatically steer the system, such as by following a guided system embedded in the floor or by using a laser guide.

Figure 9:
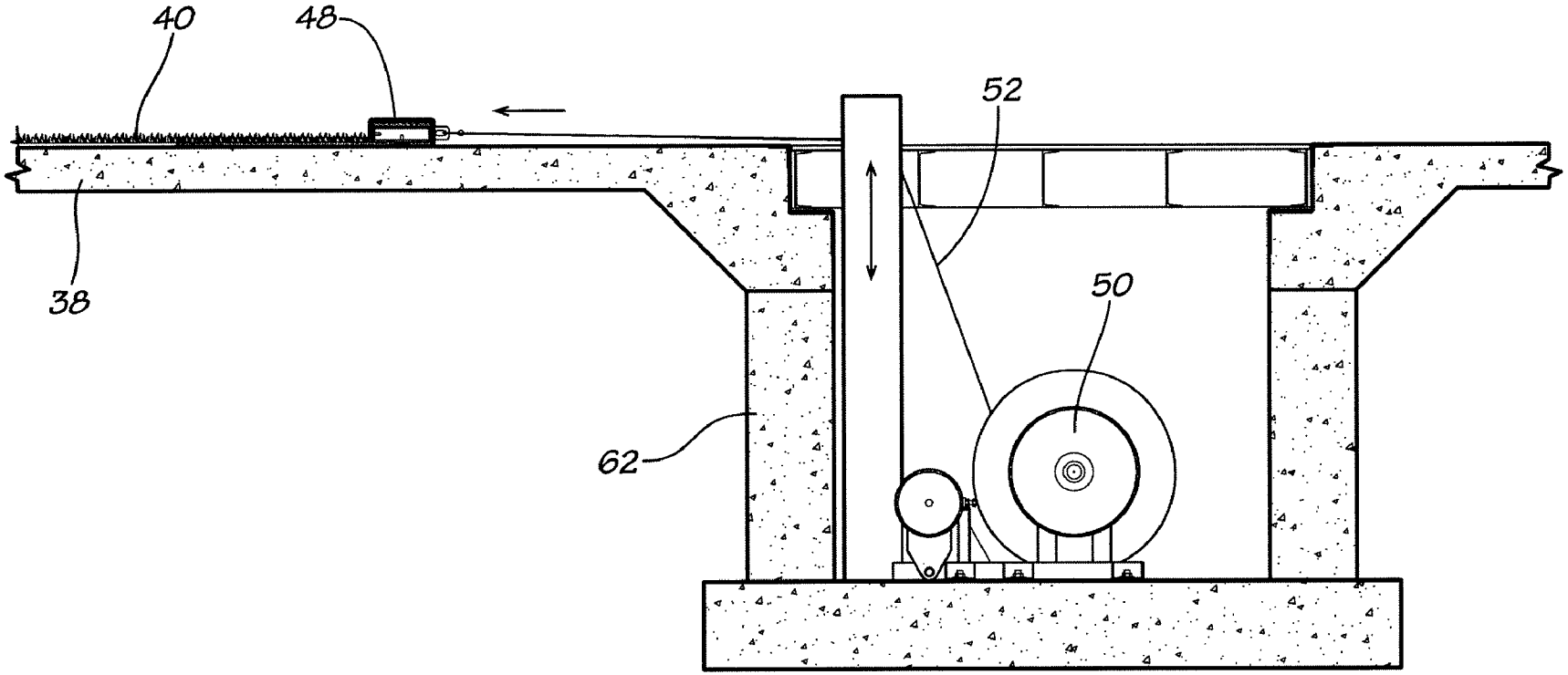
FIG. 9 is a side view of a spar and winch system according to another aspect of the invention, with the winch located in a pit.
Figure 10:
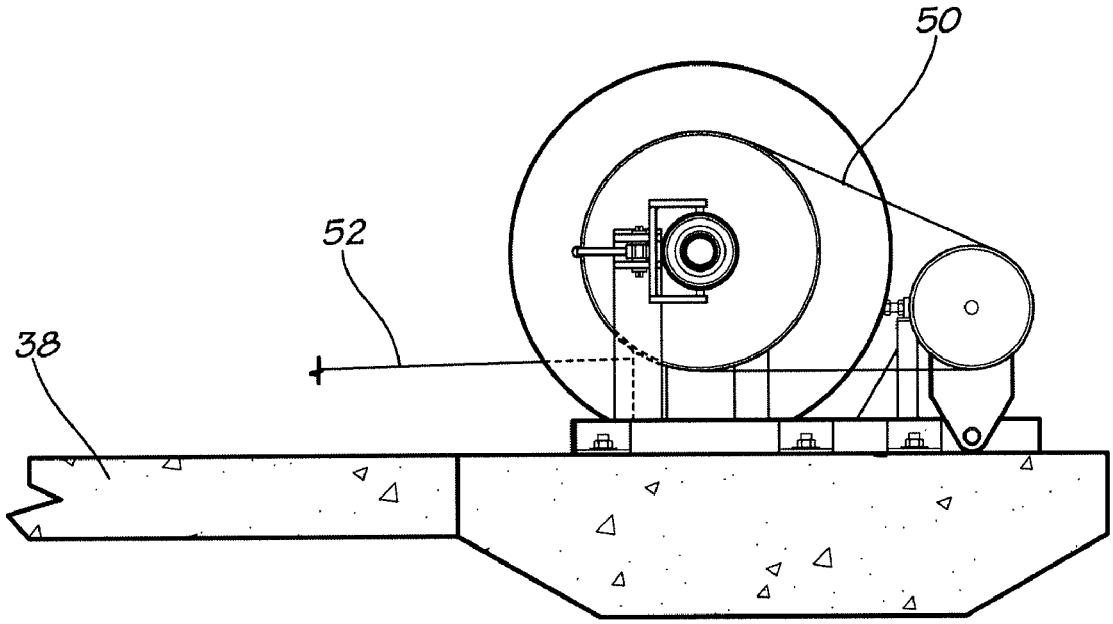
FIG. 10 is a side view of a spar and winch system according to another aspect of the invention, with the winch located on the primary surface.
Figure 11:
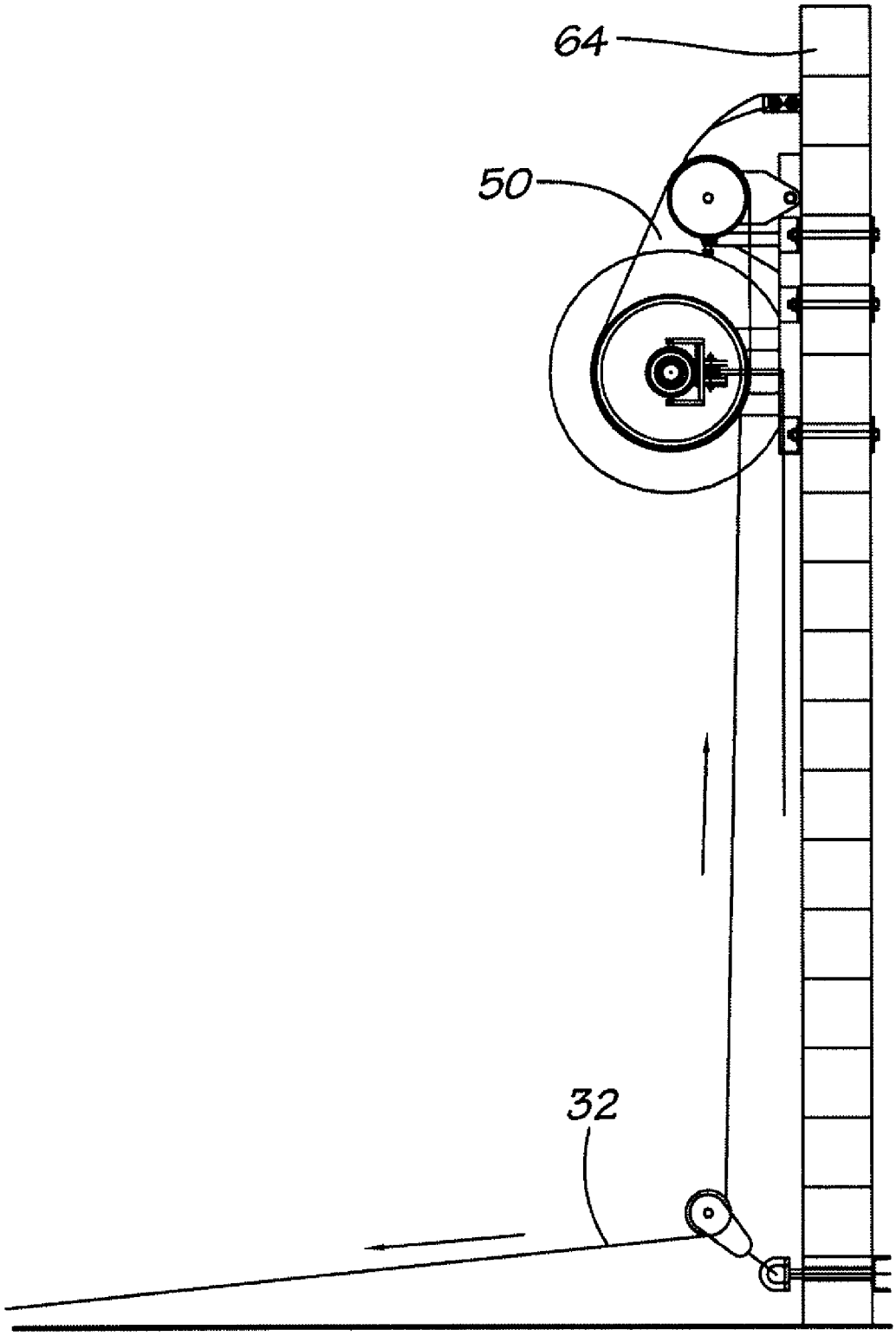
FIG. 11 is a side view of a spar and winch system according to another aspect of the invention, with the winch located on a wall.

Winches 50 are then engaged to roll out the secondary flooring 40 across the primary surface 38 using the cables 52. Winches 50 can be controlled by one central drive mechanism that is hooked up and synchronized so that winches 50 have controlled tension on spar 48. The winch and cable system may be mounted in a partial pit 62 as shown in FIG. 9, located directly on the primary surface 38 as shown in FIG. 10, or mounted on a wall 64 as shown in FIG. 11. In other embodiments, the winch and cable system can be hydraulically driven, or powered by any other suitable method. The winch and cable system can be used to help pull the slack of the secondary flooring surface across the primary surface as the secondary flooring surface is rolled out.

In some embodiments, the existing primary surface 38 includes vents for providing air flow across the primary surface 38 during roll up or roll out of the secondary flooring surface. Thus, air flow can be generated underneath the secondary flooring 40 to lift the secondary flooring 40 to assist with roll up or roll out. The air flow system is driven by a variable speed drive for uniform distribution of air so that the secondary flooring 40 lifts evenly. In one embodiment, the air flow system is automatic and does not require action by an operator.

In an alternate embodiment, the motors 20 and 66 drive the roll out of the secondary flooring 40 and the winch and cable system is used to pull the slack out of the secondary flooring 40 as it is rolled across primary surface 38.

This system allows the end user to convert an existing primary surface to a secondary flooring surface in a short period of time using a limited amount of labor. This system also allows the end user to choose from a number of different types of secondary flooring surfaces, such as either tufted or knitted synthetic turfs, a tall or short pile product, rubberized flooring systems, an infilled or non-infilled product, natural sod, or any other surface used to cover and/or protect a primary surface. The disclosed system is not limited to use in the athletic industry, but can be utilized whenever a primary surface is to be converted into a secondary flooring surface. Because the roll out and roll up procedure can be done so quickly, a primary surface can be converted to a secondary flooring surface in a fraction of the time it took with conventional systems.

In an alternate embodiment, conversion system 10 is a portable system and is not fixed in place. If the primary surface is relatively small, such as the size of a gymnasium or a basketball court, which can be 100 feet wide by 200 feet long, the conversion system of this invention is especially well-suited as a portable system. In a portable version, the conversion system could be configured to move along tracks, such as railroad-type tracks, or along rollers. Alternatively, the system could be wheeled or made by portable by any other suitable method.

The foregoing provides specific torque and speed settings for the core motors in the First Embodiment and the Second Embodiment. The inventors found that these settings can be linearly scaled to determine settings for other embodiments by considering the weight and width of the secondary flooring. Control and setting of the torque used to roll up the secondary flooring is important because a relatively tight roll is needed in order to roll out the flooring quickly and smoothly.

Existing conversion systems to removably cover a surface with artificial turf, such as Magic Carpet® brand systems and the systems disclosed in U.S. Pat. No. 4,399,954, can be upgraded to practice the invention disclosed herein. For example, in one embodiment, the rear and front rollers of an existing system can be utilized and upgrades made to the rest of the system to include the features described above, such as the motors and adjustable speed drive units and floating core. In some embodiments, an existing system also could be used in conjunction with the winch and cable system described above.

The foregoing description is provided for describing various embodiments and structures relating to the invention. Various modifications, additions and deletions may be made to these embodiments and/or structures without departing from the scope and spirit of the invention.

We claim:

1. A conversion system for installing a secondary flooring surface over a primary flooring surface, comprising:

a core for storing the secondary flooring surface when not in use, wherein the core is driven by at least one core motor and the at least one core motor is controlled by a core drive unit;

a first roller for supporting the secondary flooring surface on the core and guiding the secondary flooring surface on and off the core, wherein the first roller is free spinning;

a second roller for supporting the secondary flooring surface on the core and guiding the secondary flooring surface on and off the core, wherein the second roller is driven by at least one roller motor and the at least one roller motor is controlled by a roller drive unit; and a transducer for determining a relative position of the core, wherein the core motor drive unit controls a torque of the at least one core motor while the secondary flooring surface is rolling onto the core and the core motor drive unit controls a speed of the at least one core motor while the secondary flooring surface is rolling off of the core based on information received from the transducer, and wherein the roller drive unit controls a speed of the at least one roller motor.

2. The system of claim 1, further comprising a frame for supporting the core and the secondary flooring surface, wherein the frame moves vertically along a pair of end shafts as the secondary flooring surface rolls on or off the core.

3. The system of claim 2, wherein the transducer determines the relative position of the core by determining the relative position of the frame.

4. The system of claim 2, further comprising a hydraulic lift connected to the frame that assists with the vertical movement of the frame supporting the core.

5. The system of claim 1, wherein at least part of the conversion system is located in a pit.

6. The system of claim 1, wherein at least part of the conversion system is located in a partial pit.

7. The system of claim 1, wherein at least part of the conversion system is a Mezzanine mounted system.

8. The system of claim 1, wherein at least part of the conversion system is a surface mounted system.

9. The system of claim 1, further comprising a winch and cable system that assists with the installation of the secondary flooring surface over the primary flooring surface.

10. The system of claim 9, wherein the winch and cable system includes wheels.

11. The system of claim 9, wherein the winch and cable system further comprises a steering mechanism.

12. The system of claim 11, wherein the steering mechanism is capable of being manually operated by only one operator.

13. The system of claim 11, wherein the steering mechanism is capable of being automatically operated.

14. A system for installing a secondary flooring surface, comprising:

a core for storing the secondary flooring surface when not in use, wherein the core is driven by at least one core motor and the at least one core motor is controlled by a core motor drive unit;

a first roller for supporting the secondary flooring surface on the core and guiding the secondary flooring surface on and off the core, wherein the first roller is free spinning; and a second roller for supporting the secondary flooring surface on the core and guiding the secondary flooring surface on and off the core, wherein the second roller is driven by at least one roller motor and the at least one roller motor is controlled by a roller drive unit;

wherein the core drive unit controls a torque of the at least one core motor while the secondary flooring surface is rolling onto the core and the core motor drive unit controls a speed of the at least one core motor while the secondary flooring surface is rolling off the core, and wherein the roller drive unit controls a speed of the at least one roller motor.

15. The system of claim 14, further comprising a frame for supporting the core and the secondary flooring surface, wherein the frame moves vertically along a pair of end shafts as the secondary flooring surface rolls on or off the core.

16. The system of claim 14, further comprising a transducer, which determines the relative position of the core.

17. The system of claim 14, wherein the secondary flooring rolls through a front of the system and the second roller is located between the first roller and the front of the system.

18. A method for rolling up a secondary flooring surface, comprising:

controlling a core motor to operate at a predefined torque, wherein the core motor controls the rotation of a core as the secondary flooring surface rolls onto the core;

allowing a first roller to spin freely, wherein the first roller guides the secondary flooring surface as it rolls onto the core and supports the secondary flooring surface on the core;

controlling a roller motor to operate at a predefined speed, wherein the roller motor controls the rotation of a second roller and the second roller guides the secondary flooring surface as it rolls onto the core and supports the secondary flooring surface on the core; and wherein the predefined speed is based on a length of the secondary flooring surface and a time allocated to roll up the secondary flooring surface.

19. The method of claim 18, wherein the predefined torque is maintained as the secondary flooring surface rolls onto the core.

20. The method of claim 18, wherein the core motor and the roller motor have similar acceleration times and deceleration times.

21. A method for rolling out a secondary flooring surface, comprising:

controlling a speed of a core motor, wherein the core motor controls the rotation of a core as the secondary flooring surface rolls off the core;

allowing a first roller to spin freely, wherein the first roller guides the secondary flooring surface as it rolls off the core and supports the secondary flooring surface on the core;

controlling a roller motor to operate at a predefined speed, wherein the roller motor controls the rotation of a second roller and the second roller guides the secondary flooring surface as it rolls off the core, and wherein the predefined speed is based on a length of the secondary flooring surface and a time allocated to roll out the secondary flooring surface and supports the secondary flooring surface on the core;

determining an amount of the secondary flooring surface on the core; and using the amount of the secondary flooring surface on the core to adjust the speed of the core motor.

22. The method of claim 21, wherein determining an amount of the secondary flooring surface on the core comprises determining a position of a frame that supports the core.

23. The method of claim 21, wherein using the amount of the secondary flooring surface on the core to adjust the speed of the core motor comprises adjusting the speed in a linear manner.

24. The method of claim 21, wherein controlling a roller motor to operate at a predefined speed comprises maintaining the predefined speed as the secondary flooring surface rolls off the core.

25. The method of claim 21, further comprising a winch and cable system that assists with pulling the secondary flooring surface across a primary flooring surface as the secondary flooring surface rolls off the core.

26. A method for rolling out a secondary flooring surface, comprising:

controlling a speed of a core motor to operate at a first predefined speed, wherein the core motor controls the rotation of a core as the secondary flooring surface rolls off the core;

allowing a first roller to spin freely, wherein the first roller guides the secondary flooring surface as it rolls off the core and supports the secondary flooring surface on the core;

controlling a roller motor to operate at a second predefined speed, wherein the roller motor controls the rotation of a second roller and the second roller guides the secondary flooring surface as it rolls off the core and supports the secondary flooring surface on the core, and wherein the second predefined speed is based on a length of the secondary flooring surface and a time allocated to roll out the secondary flooring surface.

27. The method of claim 26, wherein controlling a roller motor to operate at a predefined speed comprises maintaining the predefined speed as the secondary flooring surface rolls off the core.

28. The method of claim 26, wherein controlling a speed of a core motor to operate at a first predefined speed, comprises maintaining the predefined speed as the secondary flooring surface rolls off the core.

29. The method of claim 26, further comprising a winch and cable system that assists with pulling the secondary flooring surface across a primary flooring surface as the secondary flooring surface rolls off the core.

* * * * *